US010899524B1

(12) United States Patent
Voorhees

(10) Patent No.: US 10,899,524 B1
(45) Date of Patent: Jan. 26, 2021

(54) SELF-LOCATING STRUCTURAL PACKAGING ELEMENT

(71) Applicant: RATIONAL PACKAGING LLC, Springfield, TN (US)

(72) Inventor: Samuel C. Voorhees, Louisville, KY (US)

(73) Assignee: RATIONAL PACKAGING LLC, Springfield, TN (US)

( * ) Notice: Subject to any disclaimer, the term of this patent is extended or adjusted under 35 U.S.C. 154(b) by 71 days.

(21) Appl. No.: 16/244,676

(22) Filed: Jan. 10, 2019

Related U.S. Application Data

(63) Continuation-in-part of application No. 29/667,161, filed on Oct. 18, 2018, and a continuation-in-part of application No. 29/593,144, filed on Feb. 6, 2017, now Pat. No. Des. 871,213.

(51) Int. Cl.
*B65D 81/05* (2006.01)

(52) U.S. Cl.
CPC ..... *B65D 81/053* (2013.01); *B65D 81/054* (2013.01); *B65D 2581/053* (2013.01)

(58) Field of Classification Search
CPC ..... B65D 81/053; B65D 81/05; B65D 25/10; B65D 81/054; B65D 81/113; B65D 2581/051
USPC ..... 206/586, 453, 521
See application file for complete search history.

(56) References Cited

U.S. PATENT DOCUMENTS 3,244,347 A 4/1966 Jenk
4,050,604 A * 9/1977 Flanders ..... B65D 7/24 220/4.28
4,125,187 A * 11/1978 Vecchiotti ..... H01M 2/0237 206/521
4,244,471 A * 1/1981 Plante ..... B65D 19/0018 206/386
4,482,054 A * 11/1984 Gardner ..... B65D 81/05 206/320
4,483,444 A * 11/1984 Gardner ..... B65D 81/05 206/320
4,771,893 A 9/1988 Liebel
5,131,541 A 7/1992 Liebel
5,267,651 A * 12/1993 Hughes ..... B65D 5/5033 206/453
5,593,039 A 1/1997 Ortlieb
6,059,104 A 5/2000 Widman
(Continued)

*Primary Examiner* — Steven A. Reynolds

(74) *Attorney, Agent, or Firm* — Shaddock Law Group, PC

(57) ABSTRACT

A self-locating structural packaging element, including an elongate portion of material extending, along a longitudinal axis, from a first terminal end to a second terminal end; a vertex, defined along the longitudinal axis, from the first terminal end to the second terminal end; a first packaging element leg, extending laterally from the vertex to a distal end, the first packaging element leg having one or more alternating ridges and grooves, each of the alternating ridges and grooves of the first packaging element leg extending along the longitudinal axis; a second packaging element leg, extending laterally from the vertex to a proximal end, the second packaging element leg having one or more alternating ridges and grooves, each of the alternating ridges and grooves of the second packaging element leg extending along the longitudinal axis; and an alignment extension portion formed in a portion of the first packaging element leg.

19 Claims, 8 Drawing Sheets

(56) References Cited

U.S. PATENT DOCUMENTS

| | | | | |
|---|---|---|---|---|
| 6,186,329 | B1 | 2/2001 | Qiu | |
| 6,234,314 | B1 | 5/2001 | Qiu et al. | |
| 6,247,596 | B1 | 6/2001 | Muyskens | |
| 6,286,683 | B1 | 9/2001 | Hunt et al. | |
| 6,513,662 | B1 | 2/2003 | Stebelton | |
| 6,520,336 | B2 | 2/2003 | Baechle | |
| 6,595,367 | B2 | 7/2003 | Baechle | |
| 7,014,046 | B2 | 3/2006 | Niu et al. | |
| 7,048,118 | B2 * | 5/2006 | Baechle | B65D 61/00 206/320 |
| 7,111,735 | B2 | 9/2006 | Lowry | |
| 7,128,214 | B2 | 10/2006 | Qiu et al. | |
| 7,137,517 | B2 | 11/2006 | Lowry et al. | |
| 7,281,648 | B2 | 10/2007 | Lowry | |
| 7,383,952 | B2 * | 6/2008 | Kruelle | B65D 81/053 206/453 |
| 7,625,616 | B2 | 2/2009 | Van de Camp | |
| 7,841,469 | B2 | 11/2010 | Muyskens | |
| 8,079,476 | B2 * | 12/2011 | Simms | B65D 81/054 206/453 |
| 8,297,492 | B2 | 10/2012 | Muyskens | |
| 9,428,298 | B2 | 8/2016 | Bersamin et al. | |
| 2003/0052037 | A1 | 3/2003 | Baechle et al. | |
| 2003/0111383 | A1 * | 6/2003 | Qiu | B65D 81/054 206/586 |
| 2005/0035257 | A1 | 2/2005 | Niu et al. | |
| 2005/0092633 | A1 | 5/2005 | Baechle | |
| 2005/0136204 | A1 | 6/2005 | Qui et al. | |
| 2006/0070911 | A1 | 4/2006 | Lowry | |
| 2006/0108408 | A1 | 5/2006 | Lowry | |
| 2006/0157380 | A1 | 7/2006 | Lowry | |
| 2006/0292368 | A1 | 12/2006 | Van de Camp | |
| 2008/0237419 | A1 | 10/2008 | Baechle et al. | |
| 2010/0000906 | A1 | 1/2010 | Muyskens | |
| 2011/0278310 | A1 | 11/2011 | Muyskens | |
| 2015/0122690 | A1 | 5/2015 | Bersamin et al. | |
| 2018/0312319 | A1 * | 11/2018 | Bower | B65D 81/054 |

* cited by examiner

SELF-LOCATING STRUCTURAL PACKAGING ELEMENT

CROSS-REFERENCE TO RELATED APPLICATIONS

This patent application claims the benefit of U.S. patent application Ser. No. 29/667,161 filed Oct. 18, 2018, the benefit of U.S. patent application Ser. No. 15/964,439, filed Apr. 27, 2018, the benefit of U.S. patent application Ser. No. 29/593,144 filed Feb. 6, 2017, and the benefit of U.S. patent application Ser. No. 29/593,147, filed Feb. 6, 2017, the disclosures of which are incorporated herein in their entireties by reference.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

NOTICE OF COPYRIGHTED MATERIAL

The disclosure of this patent document contains material that is subject to copyright protection. The copyright owner has no objection to the reproduction by anyone of the patent document or the patent disclosure, as it appears in the Patent and Trademark Office patent file or records, but otherwise reserves all copyright rights whatsoever. Unless otherwise noted, all trademarks and service marks identified herein are owned by the applicant.

BACKGROUND OF THE INVENTION

1. Field of the Invention

The present disclosure relates generally to the field of packaging elements. More specifically, the present disclosure relates to a self-locating structural packaging element.

2. Description of Related Art

It is generally known to use various packaging assemblies to package products for storage or shipping. Typically, packaging assemblies are constructed so as to stabilize the contained item or items and provide a certain degree of cushioning against breakage, while being moved or transported.

Depending on the size, shape, and/or weight of the contained item or items, packaging assemblies may be placed atop one another or pallets for storage, shipping, or transportation.

Typically, packaging assemblies or elements must be manually aligned with and adhesively attached, via tape or adhesive strips, to the item or items.

Any discussion of documents, acts, materials, devices, articles, or the like, which has been included in the present specification is not to be taken as an admission that any or all of these matters form part of the prior art base or were common general knowledge in the field relevant to the present disclosure as it existed before the priority date of each claim of this application.

BRIEF SUMMARY OF THE INVENTION

However, typical packaging assemblies have various shortcomings. Among other things, known packaging assemblies are cumbersome and often require that the packaging elements or assemblies be manually aligned with the article or product which the packaging elements or assemblies or to provide protective cushioning. Once manually positioned, the packaging elements or assemblies must then be taped or wrapped the article or product to remain in a desired position or orientation. If the packaging elements or assemblies are misplaced or improperly attached, they do not provide the desired cushioning to the article or product.

In various other exemplary, non-limiting embodiments, the self-locating structural packaging element comprises an elongate portion of material extending, along a longitudinal axis, from a first terminal end to a second terminal end; a vertex, defined along the longitudinal axis, from the first terminal end to the second terminal end; a first packaging element leg, extending laterally from the vertex to a distal end, the first packaging element leg having one or more alternating ridges and grooves, each of the alternating ridges and grooves of the first packaging element leg extending along the longitudinal axis; a second packaging element leg, extending laterally from the vertex to a proximal end, the second packaging element leg having one or more alternating ridges and grooves, each of the alternating ridges and grooves of the second packaging element leg extending along the longitudinal axis; and an alignment extension portion formed in a portion of the first packaging element leg.

The alignment extension portion extends so as to be at least partially received within a recess, groove, or other feature formed in an article or product with which the self-locating structural packaging element is to be utilized. The remaining portions of the first packaging element leg, which extend beyond the alignment extension portion, are formed so as to contact one or more surfaces of the article or product. In this manner, by aligning the alignment extension portion with and at least at least partially within the recess, groove, or other feature formed in the article or product, the self-locating structural packaging element can be maintained in a desired position relative to the article or product, to provide package cushioning or support to the article or product during shipping.

In certain exemplary, non-limiting embodiments, the vertex bisects the self-locating structural packaging element proximate a center of the self-locating structural packaging element.

In certain exemplary, non-limiting embodiments, the vertex is defined offset from a longitudinal center of the self-locating structural packaging element.

In certain exemplary, non-limiting embodiments, a lateral length of the first packaging element leg, perpendicular to the longitudinal axis, is substantially similar to a lateral length of the second packaging element leg.

In certain exemplary, non-limiting embodiments, a lateral length of the first packaging element leg, perpendicular to the longitudinal axis, is substantially different from a lateral length of the second packaging element leg.

In certain exemplary, non-limiting embodiments, each of the alternating ridges and grooves are parallel and alternating ridges and grooves.

In certain exemplary, non-limiting embodiments, a transverse cross-section of the second packaging element leg forms a mirror image of a transverse cross-section of the first packaging element legs.

In certain exemplary, non-limiting embodiments, the vertex defines a furthest extent of the self-locating structural packaging element.

In certain exemplary, non-limiting embodiments, an outer wall forms an exterior surface of the self-locating structural packaging element and an inner wall forms and interior surface of the self-locating structural packaging element and wherein the outer wall of the self-locating structural packaging element is substantially coextensive with the inner wall of the self-locating structural packaging element.

In certain exemplary, non-limiting embodiments, the self-locating structural packaging element is formed of cardboard, thick paper, pasteboard, paperboard, container board, corrugated fiberboard, box board, or chipboard.

In certain exemplary, non-limiting embodiments, the first packaging element leg and the second packaging element leg are each curvilinear along a respective length, from the vertex to the distal end and from the vertex to the proximal end.

In certain exemplary, non-limiting embodiments, the alternating ridges and grooves are formed such that the first packaging element leg and the second packaging element leg each comprise a sinusoidal succession of waves or curves.

In certain exemplary, non-limiting embodiments, the vertex allows for a degree of inward and/or outward flexion of at least a portion of the first packaging element leg relative to at least a portion of the second packaging element leg.

In certain exemplary, non-limiting embodiments, the alternating ridges and grooves allow for a degree of inward and/or outward flexion of at least a portion of the first packaging element leg and at least a portion of the second packaging element leg.

In certain exemplary, non-limiting embodiments, the alignment extension portion is formed in the distal end of the first packaging element leg.

In certain exemplary, non-limiting embodiments, the alignment extension portion is formed by a portion of material extending from the first packaging element leg.

In certain exemplary, non-limiting embodiments, the alignment extension portion is formed by removal of material in a portion of the distal end, proximate the first terminal end and the second terminal end of the self-locating structural packaging element.

In certain exemplary, non-limiting embodiments, the alignment extension portion is formed by removal of material in a portion of the distal end, proximate the first terminal end and the second terminal end of the self-locating structural packaging element, and wherein support wing portions are formed by portions of the first packaging element leg that extend beyond each side of the alignment extension portion.

In certain exemplary, non-limiting embodiments, the alignment extension portion extends from a first alignment extension portion terminal end to a second alignment extension portion terminal end, and wherein the first alignment extension portion terminal end does not extend to the first terminal end and the second alignment extension portion terminal end does not extend to the second terminal end.

In various other exemplary, non-limiting embodiments, the self-locating structural packaging element comprises an elongate portion of material extending, along a longitudinal axis, from a first terminal end to a second terminal end; a vertex, defined along the longitudinal axis, from the first terminal end to the second terminal end; a first packaging element leg, extending laterally from the vertex to a distal end, the first packaging element leg having one or more alternating ridges and grooves, each of the alternating ridges and grooves of the first packaging element leg extending along the longitudinal axis; a second packaging element leg, extending laterally from the vertex to a proximal end, the second packaging element leg having one or more alternating ridges and grooves, each of the alternating ridges and grooves of the second packaging element leg extending along the longitudinal axis; and an alignment extension portion formed in the distal end of the first packaging element leg, wherein the alignment extension portion extends from a first alignment extension portion terminal end to a second alignment extension portion terminal end, and wherein the first alignment extension portion terminal end does not extend to the first terminal end and the second alignment extension portion terminal end does not extend to the second terminal end.

In various other exemplary, non-limiting embodiments, the self-locating structural packaging element comprises an elongate portion of material extending, along a longitudinal axis, from a first terminal end to a second terminal end; a vertex, defined along the longitudinal axis; a first packaging element leg, extending from the vertex to a distal end, the first packaging element leg having one or more alternating ridges and grooves; a second packaging element leg, extending from the vertex to a proximal end, the second packaging element leg having one or more alternating ridges and grooves; and an alignment extension portion formed in the distal end of the first packaging element leg, wherein a first alignment extension portion terminal end does not extend to the first terminal end and a second alignment extension portion terminal end does not extend to the second terminal end.

Accordingly, the present disclosure provides a self-locating structural packaging element that can be easily stored in a relatively compact configuration, awaiting use.

The present disclosure separately provides a self-locating structural packaging element that can be easily and accurately positioned relative to a packaged article or product, when needed.

The present disclosure separately provides a self-locating structural packaging element that provides lower costs for handling and storage.

The present disclosure separately provides a self-locating structural packaging element with a high degree of compressional strength.

These and other aspects, features, and advantages of the present disclosure are described in or are apparent from the following detailed description of the exemplary, non-limiting embodiments of the present disclosure and the accompanying figures. Other aspects and features of embodiments of the present disclosure will become apparent to those of ordinary skill in the art upon reviewing the following description of specific, exemplary embodiments of the present disclosure in concert with the figures. While features of the present disclosure may be discussed relative to certain embodiments and figures, all embodiments of the present disclosure can include one or more of the features discussed herein.

Further, while one or more embodiments may be discussed as having certain advantageous features, one or more of such features may also be used with the various embodiments of the systems, methods, and/or apparatuses discussed herein. In similar fashion, while exemplary embodiments may be discussed below as device, system, or method embodiments, it is to be understood that such exemplary embodiments can be implemented in various devices, systems, and methods of the present disclosure.

Any benefits, advantages, or solutions to problems that are described herein with regard to specific embodiments are not intended to be construed as a critical, required, or essential feature(s) or element(s) of the present disclosure or the claims.

BRIEF DESCRIPTION OF THE SEVERAL VIEWS OF THE DRAWINGS

As required, detailed exemplary embodiments of the present disclosure are disclosed herein. However, it is to be understood that the disclosed embodiments are merely exemplary of the present disclosure that may be embodied in various and alternative forms, within the scope of the present disclosure. The figures are not necessarily to scale; some features may be exaggerated or minimized to illustrate details of particular components. Therefore, specific structural and functional details disclosed herein are not to be interpreted as limiting, but merely as a basis for the claims and as a representative basis for teaching one skilled in the art to employ the present disclosure.

The exemplary embodiments of the present disclosure will be described in detail, with reference to the following figures, wherein like reference numerals refer to like parts throughout the several views, and wherein.

DETAILED DESCRIPTION OF EXEMPLARY EMBODIMENTS OF THE INVENTION

Figure 1:
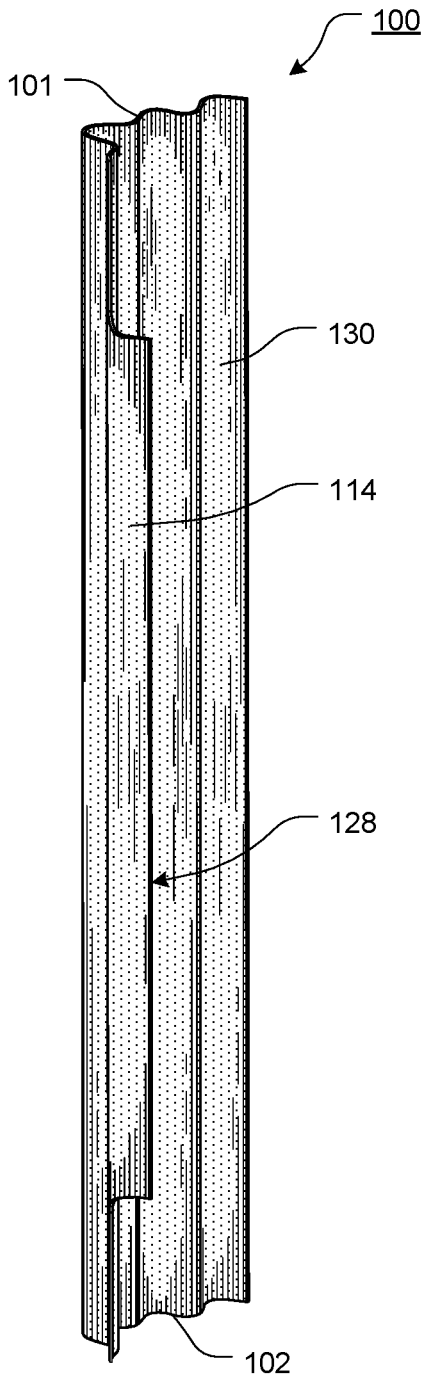
FIG. 1 illustrates a front perspective view of an exemplary embodiment of a self-locating structural packaging element, according to the present disclosure.
Figure 2:
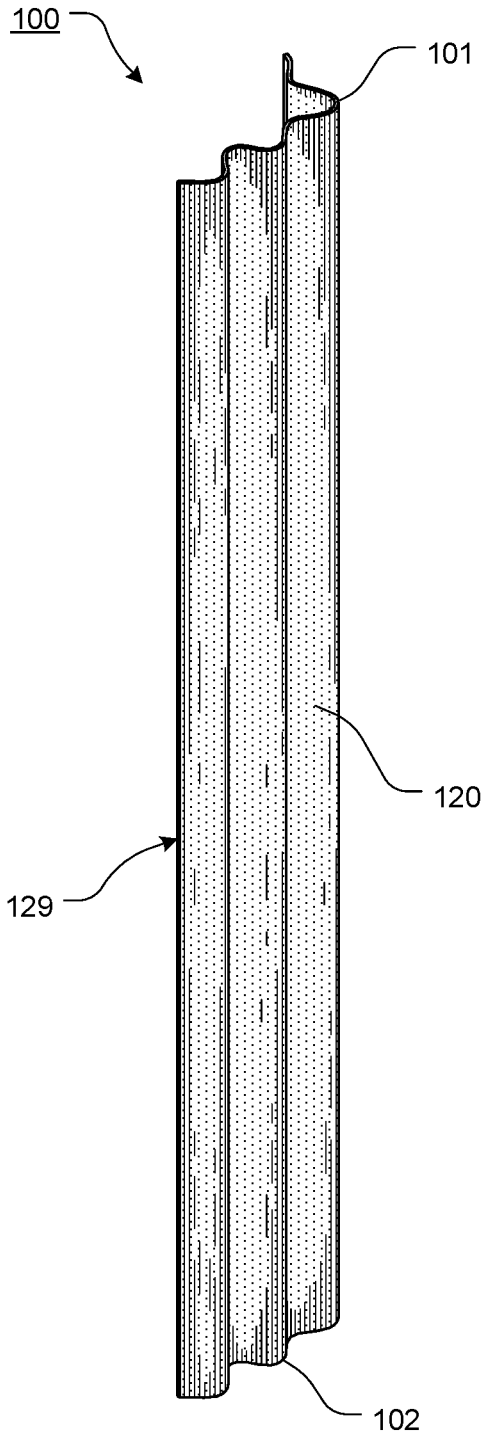
FIG. 2 illustrates a rear perspective view of an exemplary embodiment of a self-locating structural packaging element, according to the present disclosure.
Figure 3:
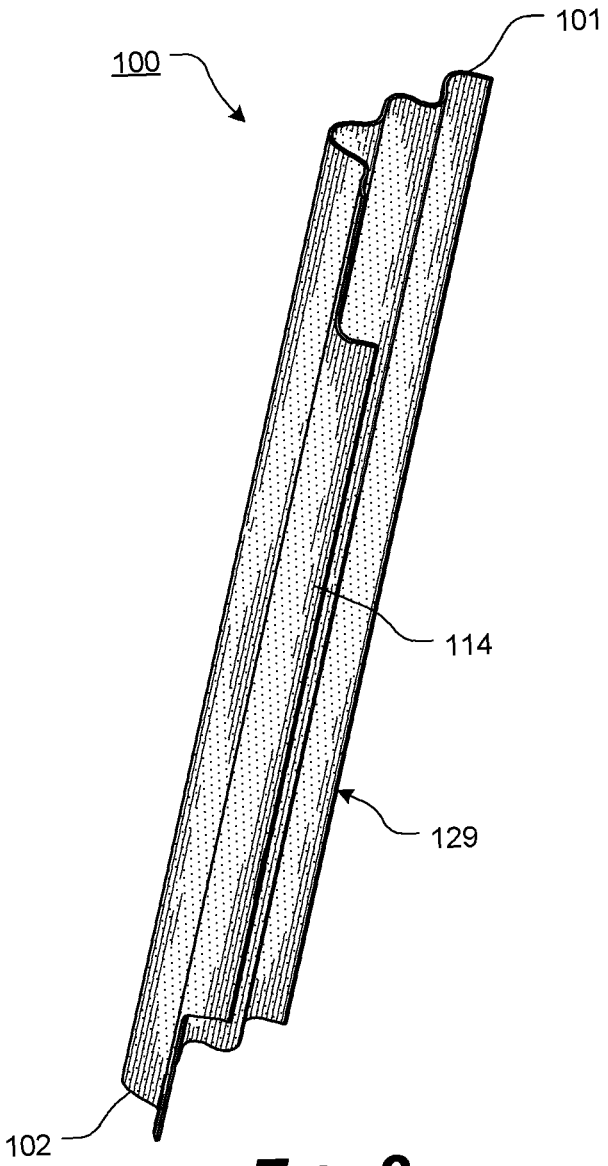
FIG. 3 illustrates a front perspective view of an exemplary embodiment of a self-locating structural packaging element, according to the present disclosure.
Figure 4:
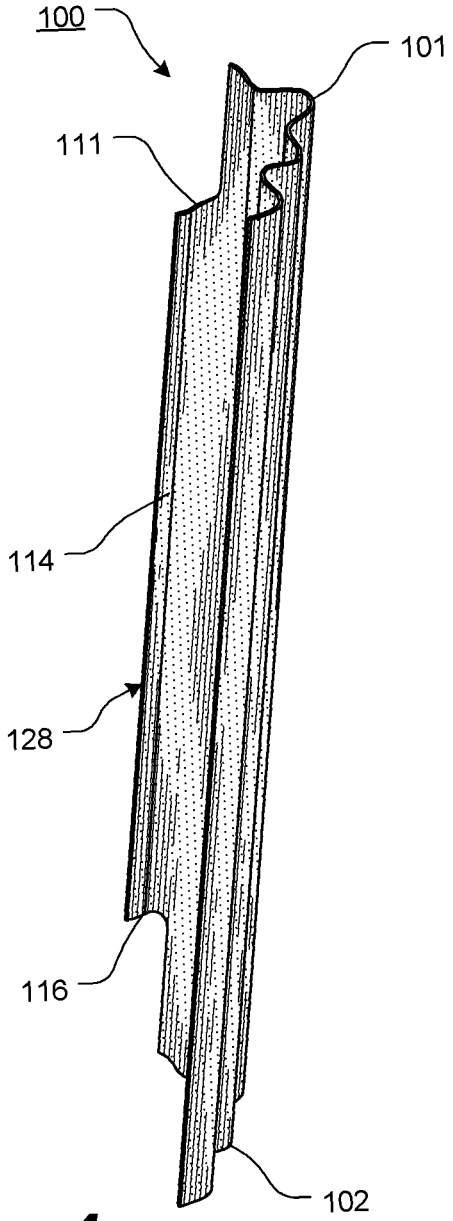
FIG. 4 illustrates a rear perspective view of an exemplary embodiment of a self-locating structural packaging element, according to the present disclosure.
Figure 5:
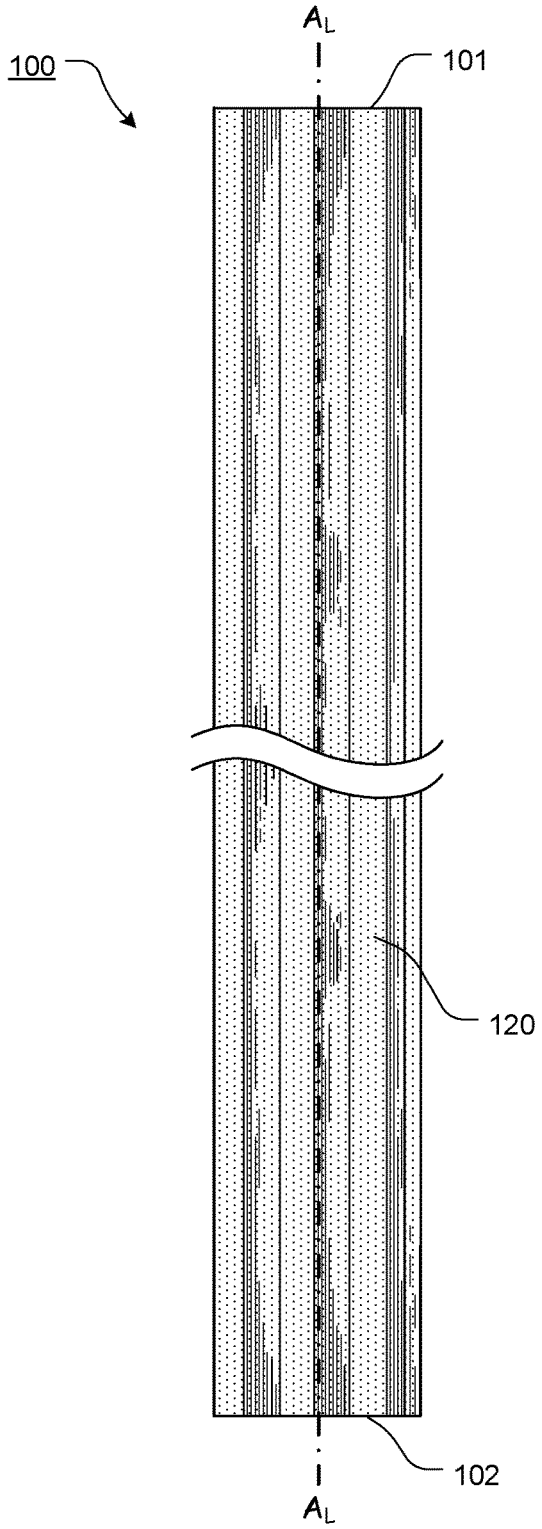
FIG. 5 illustrates a top view of an exemplary embodiment of a self-locating structural packaging element, according to the present disclosure.
Figure 6:
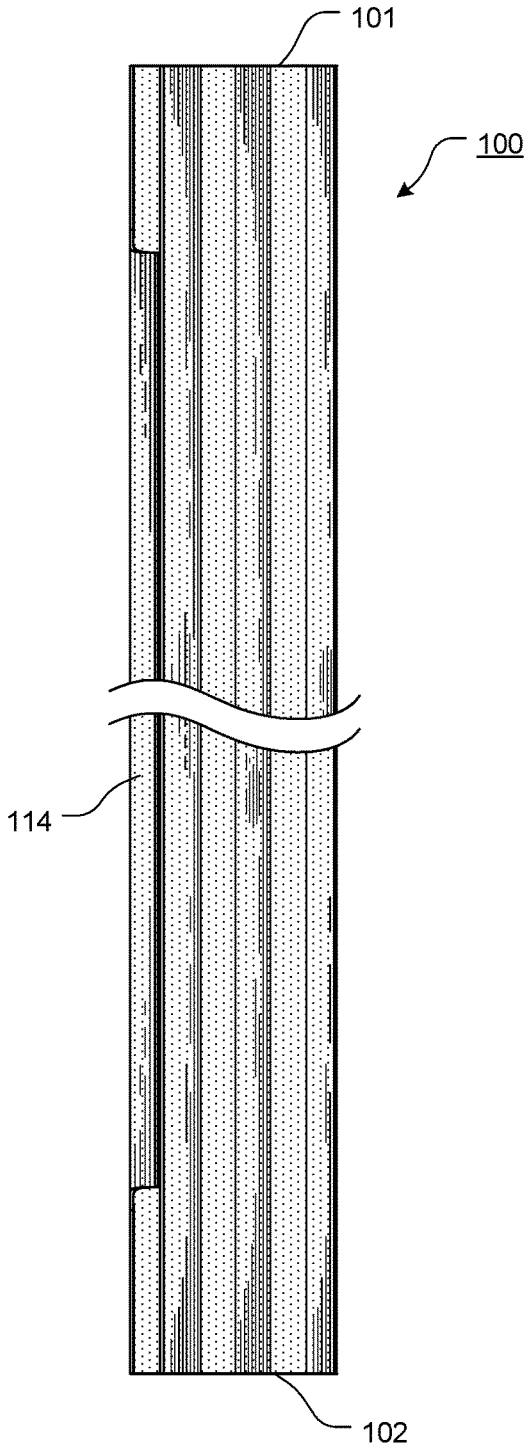
FIG. 6 illustrates a bottom view of an exemplary embodiment of a self-locating structural packaging element, according to the present disclosure.
Figure 7:
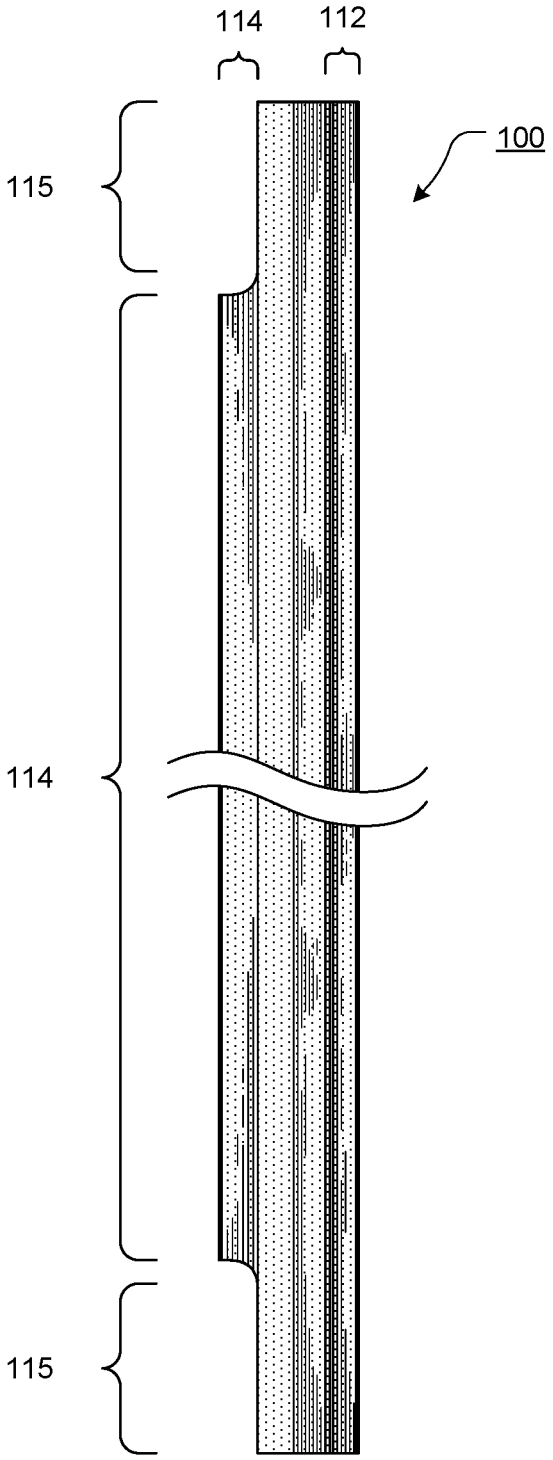
FIG. 7 illustrates a front view of an exemplary embodiment of a tray or endcap element, according to the present disclosure.
Figure 8:
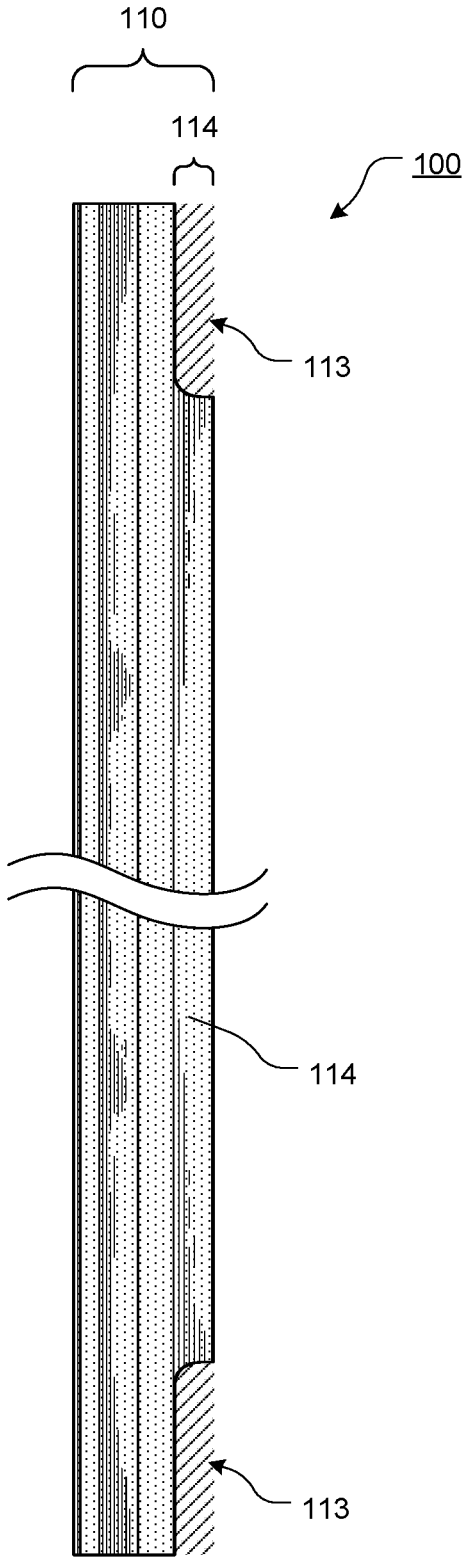
FIG. 8 illustrates a rear view of an exemplary embodiment of a tray or endcap element, according to the present disclosure.

For simplicity and clarification, the design factors and operating principles of the self-locating structural packaging element are explained with reference to various exemplary embodiments of a self-locating structural packaging element according to the present disclosure. The basic explanation of the design factors and operating principles of the self-locating structural packaging element is applicable for the understanding, design, and operation of the self-locating structural packaging element of the present disclosure. It should be appreciated that the self-locating structural packaging element can be adapted to applications where a packaging element can be used.

As used herein, the word "may" is meant to convey a permissive sense (i.e., meaning "having the potential to"), rather than a mandatory sense (i.e., meaning "must"). Unless stated otherwise, terms such as "first" and "second" are used to arbitrarily distinguish between the exemplary embodiments and/or elements such terms describe. Thus, these terms are not necessarily intended to indicate temporal or other prioritization of such exemplary embodiments and/or elements.

The term "coupled", as used herein, is defined as connected, although not necessarily directly, and not necessarily mechanically. The terms "a" and "an" are defined as one or more unless stated otherwise.

Throughout this application, the terms "comprise" (and any form of comprise, such as "comprises" and "comprising"), "have" (and any form of have, such as "has" and "having"), "include", (and any form of include, such as "includes" and "including") and "contain" (and any form of contain, such as "contains" and "containing") are used as open-ended linking verbs. It will be understood that these terms are meant to imply the inclusion of a stated element, integer, step, or group of elements, integers, or steps, but not the exclusion of any other element, integer, step, or group of elements, integers, or steps. As a result, a system, method, or apparatus that "comprises", "has", "includes", or "contains" one or more elements possesses those one or more elements but is not limited to possessing only those one or more elements. Similarly, a method or process that "comprises", "has", "includes" or "contains" one or more operations possesses those one or more operations but is not limited to possessing only those one or more operations.

It should also be appreciated that the terms "packaging element" and "self-locating structural packaging element" are used for basic explanation and understanding of the operation of the systems, methods, and apparatuses of the present disclosure. Therefore, the terms "packaging element" and "self-locating structural packaging element" are not to be construed as limiting the systems, methods, and apparatuses of the present disclosure.

Turning now to the appended drawing figures, FIGS. 1-13 illustrate certain elements and/or aspects of an exemplary embodiment of the self-locating structural packaging element 100, according to the present disclosure. In illustrative, non-limiting embodiment(s) of the present disclosure, as illustrated most clearly in FIGS. 1-12, the self-locating structural packaging element 100 comprises an elongate portion of material that extends, along a longitudinal axis, $A_L$, from a first terminal end 101 to a second terminal end 102. In various exemplary embodiments, the self-locating structural packaging element 100 extends continuously, in an uninterrupted manner, from the first terminal end 101 to the second terminal end 102. Alternatively, one or more notches or recesses may optionally be formed in one or more areas, along the self-locating structural packaging element 100, between the first terminal end 101 and the second terminal end 102.

A vertex 122 is defined along the self-locating structural packaging element 100. The vertex 122 generally extends, along the longitudinal axis, $A_L$, from the first terminal end 101 to the second terminal end 102. The vertex 122 defines a line, extending along the longitudinal axis, $A_L$, from which the first packaging element leg 110 and the second packaging element leg 112 extend. In certain exemplary, non-limiting embodiments, the vertex 122 bisects the self-locating structural packaging element 100, along the longitudinal axis, $A_L$, proximate a center of the self-locating structural packaging element 100. Alternatively, the vertex 122 extends along a longitudinal axis, $A_L$, but is located offset from a center of the self-locating structural packaging element 100. Thus, in certain exemplary embodiments, a length of the first packaging element leg 110 is substantially similar to a length of the second packaging element leg 112. Alternatively, a length of the first packaging element leg 110 may be different from a length of the second packaging element leg 112.

In certain exemplary embodiments, a transverse cross-section of the second packaging element leg 112 forms a mirror image of a transverse cross-section of the first packaging element legs 110. However, it should be appreciated that it is not necessary for the transverse cross-section of the second packaging element leg 112 to form a mirror image of a transverse cross-section of the first packaging element legs 110. Thus, a transverse cross-section of the second packaging element leg 112 may have alternating ridges 126 and grooves 124 that are not mirror images of the alternating ridges 126 and grooves 124 of a transverse cross-section of the first packaging element legs 110.

Thus, it should be appreciated that the overall length of the first packaging element leg 110 and the second packaging element leg 112 is a design choice, based upon the desired engine or christening provided by the self-locating structural packaging element 100 and/or the size and shape of the article or product with which the self-locating structural packaging element 100 is to be utilized.

Generally, the vertex 122 defines a first furthest extent of the self-locating structural packaging element 100.

The first packaging element leg 110 extends laterally from the vertex 122 to a distal end 128, while the second packaging element leg 112 extends laterally from the vertex 122 to a proximal end 129. The proximal end 129 extends from the vertex 122 in a direction that is generally away from the direction that the distal end 128 extends from the vertex 122.

In certain exemplary, nonlimiting embodiments, reference lines, R1 and R2, from the vertex 122 to the distal end 128 and from the vertex 122 to the proximal end 129 are formed at an angle θ, which is approximately 90°. In certain other exemplary, nonlimiting embodiments, the reference lines, R1 and R2, are formed at an angle θ, which is approximately 75° to 105°. In still other exemplary, nonlimiting embodiments, the reference lines, R1 and R2, are formed at an angle θ, which is an acute or obtuse angle.

Figure 9:
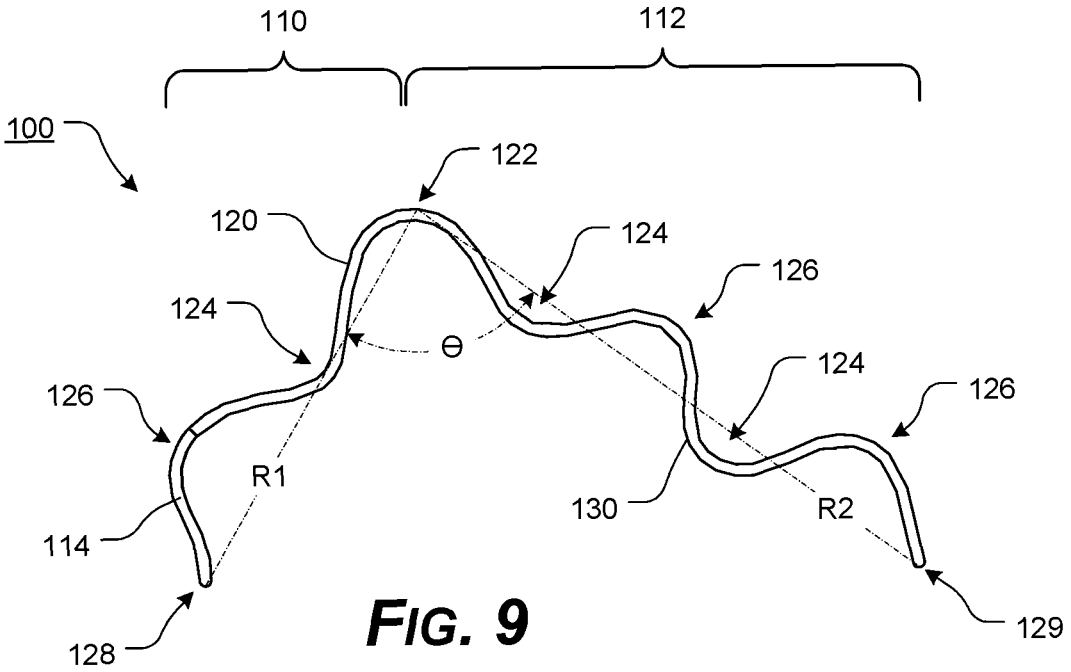
FIG. 9 illustrates a right side view of an exemplary embodiment of a self-locating structural packaging element, according to the present disclosure.
Figure 10:
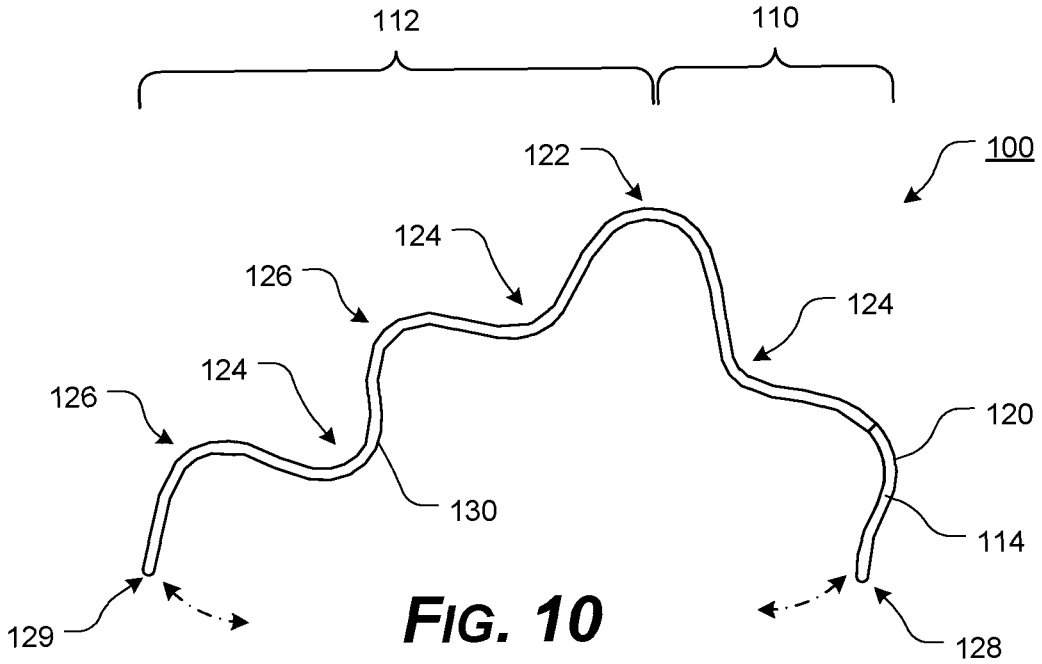
FIG. 10 illustrates a left side view of an exemplary embodiment of a self-locating structural packaging element, according to the present disclosure.
Figure 11:
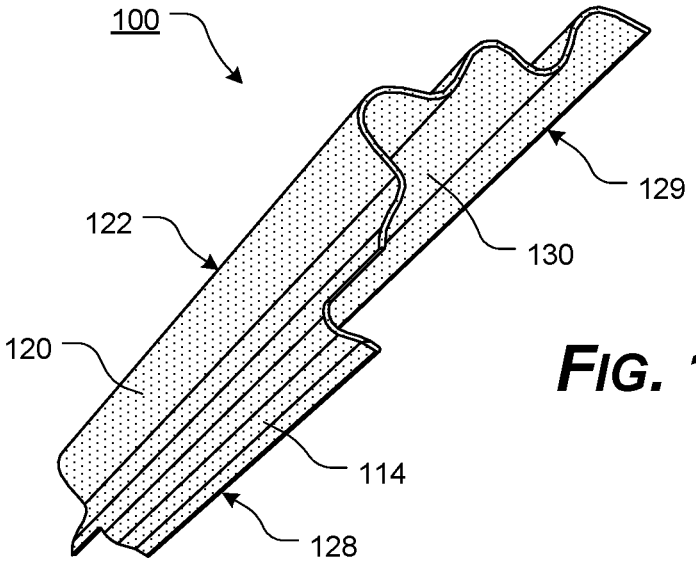
FIG. 11 illustrates a right side perspective view of an exemplary embodiment of a self-locating structural packaging element, according to the present disclosure.
Figure 12:
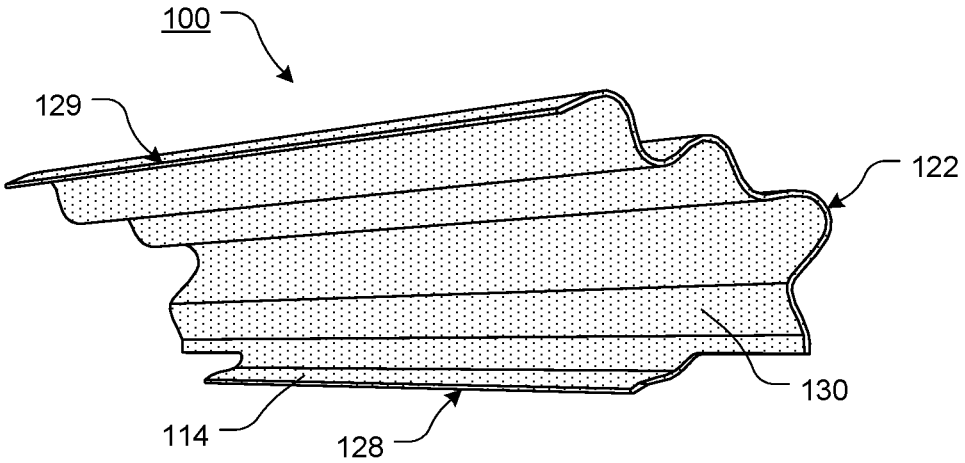
FIG. 12 illustrates a left side perspective view of an exemplary embodiment of a self-locating structural packaging element, according to the present disclosure.

Typically, when viewed from the right side or left side, as illustrated in FIGS. 9 and 10, respectively, the first packaging element leg 110 includes one or more alternating ridges 126 and grooves 124, formed along its length. Likewise, the second packaging element leg 112 includes one or more alternating ridges 126 and/or grooves 124, along its length. Each of the alternating ridges 126 and grooves 124 of the first packaging element leg 110 and the second packaging element leg 112 extends, along or substantially parallel to the longitudinal axis, $A_L$, of the self-locating structural packaging element 100. In certain exemplary, nonlimiting embodiments, each of the alternating ridges 126 and grooves 124 are parallel and alternating ridges 126 and grooves 124.

By including the alternating ridges 126 and grooves 124, the first packaging element leg 110 and the second packaging element leg 112 are each curvilinear along its respective length, from the vertex 122 to the distal end 128 and from the vertex 122 to the proximal end 129. The alternating ridges 126 and grooves 124 may be formed such that the first packaging element leg 110 and the second packaging element leg 112 each comprise a sinusoidal succession of waves or curves, along the respective lengths, from the vertex 122 to the distal end 128 and from the vertex 122 to the proximal end 129.

An outer wall 120 forms an exterior surface of the self-locating structural packaging element 100, while an inner wall 130 forms and interior surface of the self-locating structural packaging element 100. As used herein, the terms "outer", "exterior", "inner", and "interior" are used for reference only and are not to be viewed as limiting the present disclosure. In certain exemplary, non-limiting embodiments, the outer wall 120 of the self-locating structural packaging element 100 is substantially coextensive with the inner wall 130 of the self-locating structural packaging element 100.

Because of the inclusion of the alternating ridges 126 and grooves 124, the self-locating structural packaging element 100 is better able to resist end to end compression, parallel to the longitudinal axis, $A_L$, of the self-locating structural packaging element 100. Additionally, the inclusion of the alternating ridges 126 and grooves 124 helps each of the first packaging element leg 110 and second packaging element leg 112 to better resist crushing, when forces are applied to the outer wall 120 and/or the inner wall 130.

At least the vertex 122 and possibly the vertex 122 and the alternating ridges 126 and grooves 124 allow for a degree of inward and/or outward flexion and resilient recovery toward the original shape of the first packaging element leg 110 relative to the second packaging element leg 112, as illustrated by the semicircular arrows in FIG. 10.

An alignment extension portion 114 is formed in a portion of the first packaging element leg 110. The alignment extension portion 114 is formed in the distal end 128 of the first packaging element leg 110. In various exemplary, nonlimiting embodiments, the alignment extension portion 114 is formed by removal of material in a portion of the distal end 128, proximate the first terminal end 101 and the second terminal end 102 of the self-locating structural packaging element 100. The areas in which the material is removed is indicated, for purposes of illustration, by the hashed indent or recess portions 113 in FIG. 8. Alternatively, the alignment extension portion 114 may be formed by a portion of material extending from the first packaging element leg 110.

The alignment extension portion 114 extends from a first alignment extension portion terminal end 111 to a second alignment extension portion terminal end 116. The first alignment extension portion terminal end 111 does not extend to the first terminal end 101 and the second alignment extension portion terminal end 116 does not extend to the second terminal end 102 of the self-locating structural packaging element 100. Thus, a length of the alignment extension portion 114, as measured along the longitudinal axis, $A_L$, is less than a length of the self-locating structural packaging element 100, as measured along the longitudinal axis, $A_L$.

In various exemplary embodiments, the alignment extension portion 114 is positioned substantially central to the self-locating structural packaging element 100, midway between the first terminal end 101 and the second terminal end 102. Alternatively, the alignment extension portion 114 may be formed closer to the first terminal end 101 or the second terminal end 102.

Support wing portions 115 are formed by portions of the first packaging element leg 110 that extend beyond each side of the alignment extension portion 114.

The alignment extension portion 114 extends so as to be at least partially received within a recess, groove, or other feature formed in an article or product with which the self-locating structural packaging element 100 is to be utilized. The remaining portions of the first packaging element leg 110, which extend beyond the alignment extension portion 114, are formed so as to contact one or more surfaces of the article or product. In this manner, by aligning the alignment extension portion with and at least at least partially within the recess, groove, or other feature formed in the article or product, the self-locating structural packaging element 100 can be maintained in a desired position relative to the article or product, to provide package cushioning or support to the article or product during shipping.

In various exemplary embodiments, the self-locating structural packaging element 100 is substantially rigid and is formed of cardboard. Alternate materials of construction of the self-locating structural packaging element 100 may include one or more of the following: thick paper (of various types), pasteboard, paperboard, container board, corrugated fiberboard, box board, or chipboard. In still other exemplary embodiments, alternate materials of construction of the self-locating structural packaging element 100 may include one or more the following: wood, steel, stainless steel aluminum, polytetrafluoroethylene, and/or other metals, as well as various alloys and composites thereof, glass-hardened polymers, polymeric composites, polymer or fiber reinforced metals, carbon fiber or glass fiber composites, continuous fibers in combination with thermoset and thermoplastic resins, chopped glass or carbon fibers used for injection molding compounds, laminate glass or carbon fiber, epoxy laminates, woven glass fiber laminates, impregnate fibers, polyester resins, epoxy resins, phenolic resins, polyimide resins, cyanate resins, high-strength plastics, nylon, glass, or polymer fiber reinforced plastics, thermoform and/or thermoset materials, and/or various combinations of the foregoing. Thus, it should be understood that the material used to form the self-locating structural packaging element 100 is a design choice based on the desired appearance and functionality of the self-locating structural packaging element 100.

Figure 13:
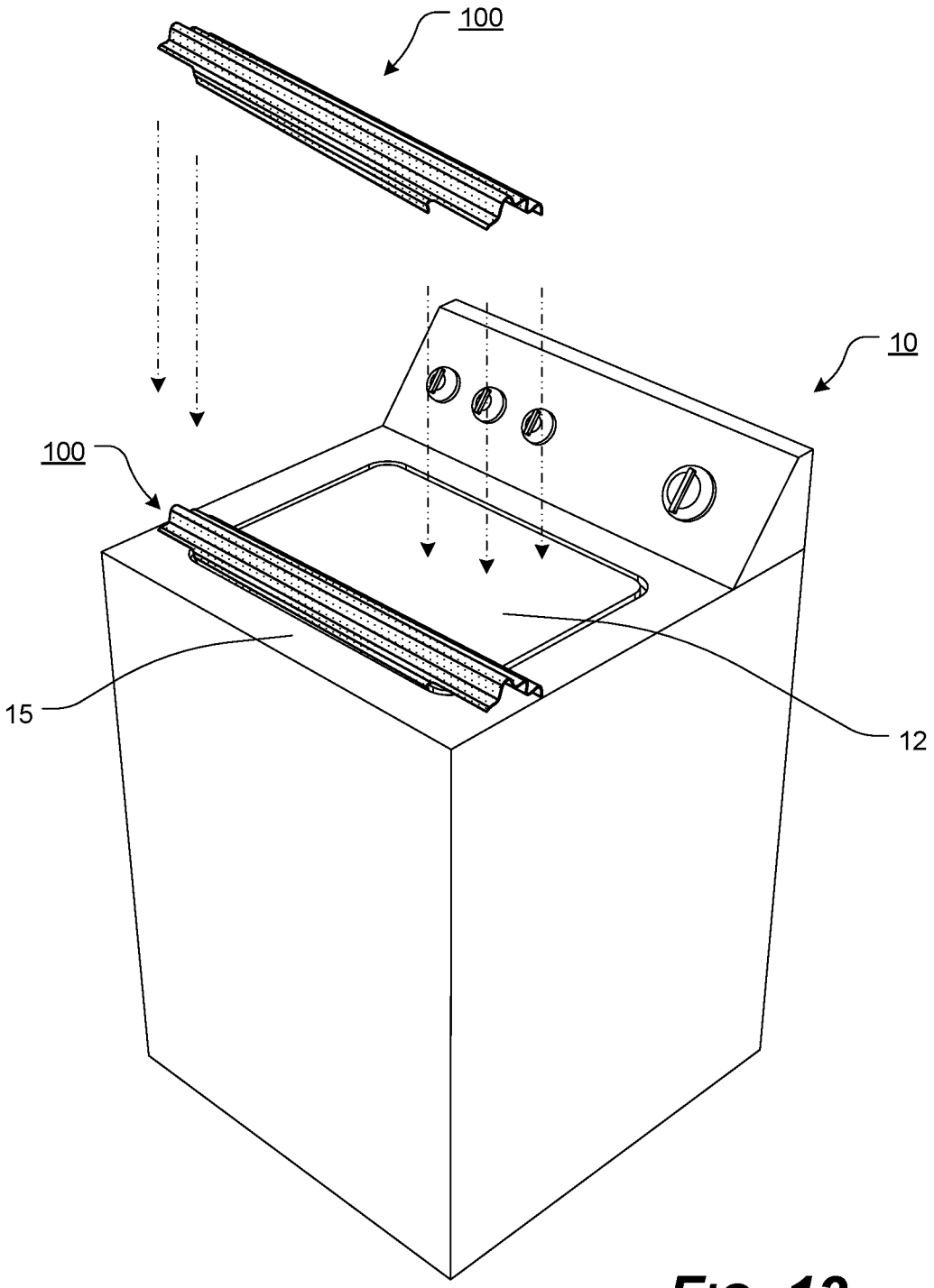
FIG. 13 illustrates a perspective view of an exemplary embodiment of a self-locating structural packaging element being fitted to an exemplary embodiment of an article or product, according to the present disclosure.
Figure 14:
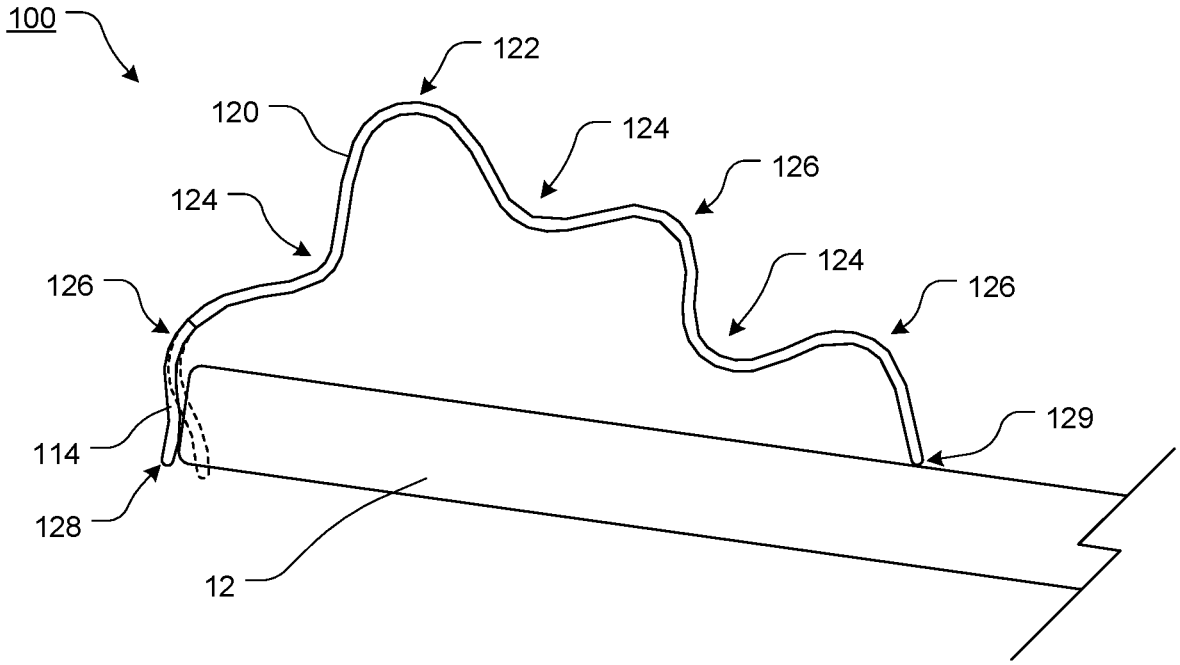
FIG. 14 illustrates a left side view of an exemplary embodiment of a self-locating structural packaging element being fitted to an exemplary embodiment of a loading lid of an exemplary embodiment of an article or product, according to the present disclosure.

FIGS. 13 and 14 illustrate the basic installation of the self-locating structural packaging element 100 on an exemplary wash machine or washer 10. As illustrated, the self-locating structural packaging element 100 is first aligned such that the longitudinal axis, $A_L$, of the self-locating structural packaging element 100 is substantially parallel to a recess or groove formed in a portion of the washer 10. In this example, the longitudinal axis, $A_L$, of the self-locating structural packaging element 100 is aligned with a recess or groove formed between a loading lid 12 and the top deck 15 of the washer 10.

Once so aligned, the alignment extension portion 114 is urged toward the washer 10, such that at least a portion of the alignment extension portion 114 is positioned at least partially within the recess or groove formed between the loading lid 12 and the top deck 15. In certain exemplary embodiments, at least a portion of the alignment extension portion 114 is urged within the recess or groove a sufficient distance such that a distal end 128 of the first packaging element leg 110 is fitted at least partially around a distal end of the loading lid 12 (an end opposite a hinged connection between the loading lid 12 and the top deck 15 of the washer 10). When so positioned, at least a portion of the proximal end 129 contacts a surface of the loading lid 12. During positioning, portions of the self-locating structural packaging element 100 may be flexed to provide additional engagement between the alignment extension portion 114 and the loading lid 12.

It should be appreciated that the self-locating structural packaging element 100 may be constructed having an any desired overall size. It should also be understood that the overall size and shape of the self-locating structural packaging element 100, and the various portions thereof, is a design choice based upon the desired functionality, compatibility with desired articles or products, and/or appearance of the self-locating structural packaging element 100.

In certain exemplary, nonlimiting embodiments, at least a portion of the inner wall 130 may be textured or includes an adhesive portion to provide a surface having a desired degree of friction relative to a purpose of the washer 10 or other support surface. Thus, at least a portion of the bottom surface of the inner wall 130 may be chosen so as to allow the self-locating structural packaging element 100 to resist movement relative to a surface.

When properly positioned, the support wing portions 115 extends beyond at least a portion of the loading lid 12 to be positioned atop the top deck 15. In various exemplary embodiments, the self-locating structural packaging element 100 is sized such that, when positioned atop the top deck 15, the first terminal end 101 and the second terminal end 102 of the self-locating structural packaging element 100 extend to opposing edges of the top deck 15.

Once appropriately positioned, the self-locating structural packaging element 100 extends from a portion of the top deck 15 so as to provide package cushioning for the washer 10.

While the present disclosure has been described in conjunction with the exemplary embodiments outlined above, the foregoing description of exemplary embodiments of the present disclosure, as set forth above, are intended to be illustrative, not limiting and the fundamental disclosed systems, methods, and/or apparatuses should not be considered to be necessarily so constrained. It is evident that the present disclosure is not limited to the particular variation set forth and many alternatives, adaptations modifications, and/or variations will be apparent to those skilled in the art.

It is to be understood that the phraseology of terminology employed herein is for the purpose of description and not of limitation. Unless defined otherwise, all technical and scientific terms used herein have the same meaning as commonly understood by one of ordinary skill in the art to which the present disclosure belongs.

In addition, it is contemplated that any optional feature of the inventive variations described herein may be set forth and claimed independently, or in combination with any one or more of the features described herein.

Furthermore, where a range of values or dimensions is provided, it is understood that every intervening value or dimension, between the upper and lower limit of that range and any other stated or intervening value or dimension in that stated range is encompassed within the present disclosure. The upper and lower limits of these smaller ranges may independently be included in the smaller ranges and is also encompassed within the present disclosure, subject to any specifically excluded limit in the stated range. Where the stated range includes one or both of the limits, ranges excluding either or both of those included limits are also included in the present disclosure.

Accordingly, the foregoing description of exemplary embodiments will reveal the general nature of the present disclosure, such that others may, by applying current knowledge, change, vary, modify, and/or adapt these exemplary, non-limiting embodiments for various applications without departing from the spirit and scope of the present disclosure and elements or methods similar or equivalent to those described herein can be used in practicing the present disclosure. Any and all such changes, variations, modifications, and/or adaptations should and are intended to be comprehended within the meaning and range of equivalents of the disclosed exemplary embodiments and may be substituted without departing from the true spirit and scope of the present disclosure.

Also, it is noted that as used herein and in the appended claims, the singular forms "a", "and", "said", and "the" include plural referents unless the context clearly dictates otherwise. Conversely, it is contemplated that the claims may be so-drafted to require singular elements or exclude any optional element indicated to be so here in the text or drawings. This statement is intended to serve as antecedent basis for use of such exclusive terminology as "solely", "only", and the like in connection with the recitation of claim elements or the use of a "negative" claim limitation(s).

What is claimed is:

1. A self-locating structural packaging element, comprising:

an elongate portion of material extending, along a longitudinal axis, from a first terminal end to a second terminal end;

a vertex, defined along said longitudinal axis, from said first terminal end to said second terminal end;

a first packaging element leg, extending laterally from said vertex to a distal end, said first packaging element leg having one or more alternating ridges and grooves, each of said alternating ridges and grooves of said first packaging element leg extending along said longitudinal axis;

a second packaging element leg, extending laterally from said vertex to a proximal end, said second packaging element leg having one or more alternating ridges and grooves, each of said alternating ridges and grooves of said second packaging element leg extending along said longitudinal axis; and an alignment extension portion formed in a portion of said first packaging element leg, wherein said alignment extension portion extends from a first alignment extension portion terminal end to a second alignment extension portion terminal end, and wherein a first recess portion extends from said first terminal end to said first alignment extension portion terminal end and a second recess portion extends from said second terminal end to said second alignment extension portion terminal end such that said first alignment extension portion terminal end does not extend to said first terminal end and said second alignment extension portion terminal end does not extend to said second terminal end.

2. The self-locating structural packaging element of claim 1, wherein said vertex bisects said self-locating structural packaging element proximate a center of said self-locating structural packaging element.

3. The self-locating structural packaging element of claim 1, wherein said vertex is defined offset from a longitudinal center of said self-locating structural packaging element.

4. The self-locating structural packaging element of claim 1, wherein a lateral length of said first packaging element leg, perpendicular to said longitudinal axis, is substantially similar to a lateral length of said second packaging element leg.

5. The self-locating structural packaging element of claim 1, wherein a lateral length of said first packaging element leg, perpendicular to said longitudinal axis, is substantially different from a lateral length of said second packaging element leg.

6. The self-locating structural packaging element of claim 1, wherein each of said alternating ridges and grooves are parallel to one another.

7. The self-locating structural packaging element of claim 1, wherein a transverse cross-section of said second packaging element leg forms a mirror image of a transverse cross-section of said first packaging element legs.

8. The self-locating structural packaging element of claim 1, wherein said vertex defines a furthest extent of said self-locating structural packaging element.

9. The self-locating structural packaging element of claim 1, wherein an outer wall forms an exterior surface of said self-locating structural packaging element and an inner wall forms an interior surface of said self-locating structural packaging element and wherein said outer wall of said self-locating structural packaging element is substantially coextensive with said inner wall of said self-locating structural packaging element.

10. The self-locating structural packaging element of claim 1, wherein said first packaging element leg and said second packaging element leg are each curvilinear along a respective length, from said vertex to said distal end and from said vertex to said proximal end.

11. The self-locating structural packaging element of claim 1, wherein said alternating ridges and grooves are formed such that said first packaging element leg and said second packaging element leg each comprise a sinusoidal succession of waves or curves.

12. The self-locating structural packaging element of claim 1, wherein said vertex allows for a degree of inward and/or outward flexion of at least a portion of said first packaging element leg relative to at least a portion of said second packaging element leg.

13. The self-locating structural packaging element of claim 1, wherein said alternating ridges and grooves allow for a degree of inward and/or outward flexion of at least a portion of said first packaging element leg and at least a portion of said second packaging element leg.

14. The self-locating structural packaging element of claim 1, wherein said alignment extension portion is formed in said distal end of said first packaging element leg.

15. The self-locating structural packaging element of claim 1, wherein said alignment extension portion is formed by a portion of material extending from said first packaging element leg.

16. The self-locating structural packaging element of claim 1, wherein said alignment extension portion is formed by removal of material in a portion of said distal end, proximate said first terminal end and said second terminal end of said self-locating structural packaging element.

17. The self-locating structural packaging element of claim 1, wherein said alignment extension portion is formed by removal of material in a portion of said distal end, proximate said first terminal end and said second terminal end of said self-locating structural packaging element, and wherein support wing portions are formed by portions of said first packaging element leg that extend beyond each side of said alignment extension portion.

18. A self-locating structural packaging element, comprising:

an elongate portion of material extending, along a longitudinal axis, from a first terminal end to a second terminal end;

a vertex, defined along said longitudinal axis, from said first terminal end to said second terminal end;

a first packaging element leg, extending laterally from said vertex to a distal end, said first packaging element leg having one or more alternating ridges and grooves, each of said alternating ridges and grooves of said first packaging element leg extending along said longitudinal axis;

a second packaging element leg, extending laterally from said vertex to a proximal end, said second packaging element leg having one or more alternating ridges and grooves, each of said alternating ridges and grooves of said second packaging element leg extending along said longitudinal axis; and an alignment extension portion formed in said distal end of said first packaging element leg, wherein said alignment extension portion extends from a first alignment extension portion terminal end to a second alignment extension portion terminal end, and wherein a first recess portion extends from said first terminal end to said first alignment extension portion terminal end and a second recess portion extends from said second terminal end to said second alignment extension portion terminal end such that said first alignment extension portion terminal end does not extend to said first terminal end and said second alignment extension portion terminal end does not extend to said second terminal end.

19. A self-locating structural packaging element, comprising:

an elongate portion of material extending, along a longitudinal axis, from a first terminal end to a second terminal end;

a vertex, defined along said longitudinal axis;

a first packaging element leg, extending from said vertex to a distal end, said first packaging element leg having one or more alternating ridges and grooves;

a second packaging element leg, extending from said vertex to a proximal end, said second packaging element leg having one or more alternating ridges and grooves; and an alignment extension portion formed in said distal end of said first packaging element leg, wherein a first recess portion extends from said first terminal end to a first alignment extension portion terminal end and a second recess portion extends from said second terminal end to a second alignment extension portion terminal end such that said first alignment extension portion terminal end does not extend to said first terminal end and said second alignment extension portion terminal end does not extend to said second terminal end.

* * * * *